United States Patent [19]

Davis, Jr.

[11] Patent Number: 4,770,844

[45] Date of Patent: Sep. 13, 1988

[54] BASKET STRUCTURE FOR A NUCLEAR FUEL TRANSPORTATION CASK

[75] Inventor: C. Fred Davis, Jr., Pensacola, Fla.

[73] Assignee: Westinghouse Electric Corp., Pittsburgh, Pa.

[21] Appl. No.: 44,695

[22] Filed: May 1, 1987

[51] Int. Cl.[4] ..... G21F 5/00

[52] U.S. Cl. ..... 376/272; 250/507.1

[58] Field of Search ..... 376/272, 438, 462; 250/506.1, 507.1, 518.1

[56] References Cited

U.S. PATENT DOCUMENTS

| | | | |
|---|---|---|---|
| Re. 31,661 | 9/1984 | Mollon | 250/507.1 |
| 4,039,842 | 8/1977 | Mollon | 250/518.1 |
| 4,143,276 | 3/1979 | Mollon | 376/272 |
| 4,177,385 | 12/1979 | Bevilacqua | 376/272 |
| 4,292,528 | 9/1981 | Shaffer et al. | 250/506.1 |
| 4,305,787 | 12/1981 | Rivacoba | 376/272 |
| 4,319,960 | 3/1982 | Larson et al. | 376/272 |
| 4,342,620 | 8/1982 | Vickrey | 376/272 |
| 4,366,115 | 12/1982 | Schlumpf | 376/272 |
| 4,543,488 | 9/1985 | Diem | 250/507.1 |

FOREIGN PATENT DOCUMENTS

| | | |
|---|---|---|
| 082317 | 6/1983 | European Pat. Off. . |
| 175140 | 3/1986 | European Pat. Off. . |
| 186487 | 7/1986 | European Pat. Off. . |

*Primary Examiner*—Deborah L. Kyle
*Assistant Examiner*—Richard Klein

[57] ABSTRACT

An improved basket structure for use within a nuclear fuel transportation cask is disclosed herein. The improved basket structure comprises an array of structurally independent rod-receiving cells formed from four individual side members wherein each member terminates into a flange of enlarged thickness along one of its lengthwise edges. The flange includes a slot that is complementary in shape to the free edge of other side members so that cells may be formed by interfitting the free edges of the side members with the complementary slots in the flanges. The flanges are thick enough so that the flanges of adjacent cells may be welded together with no appreciable warpage. When the basket is fully assembled, the flanges form spacing blocks between the adjacent cells which maintain subcriticality in the nuclear fuel contained therein.

20 Claims, 3 Drawing Sheets

BASKET STRUCTURE FOR A NUCLEAR FUEL TRANSPORTATION CASK

BACKGROUND OF THE INVENTION

This invention generally relates to casks for transporting nuclear fuel rods, and is specifically concerned with a modular cell wall that provides an improved basket structure for use within such a transportation cask.

Basket structures for use in conjunction with fuel rod transportation casks are known in the prior art. Generally, such baskets are formed from an "eggcrate" of stainless steel plates that are slotted and interfitted to define an array of square, elongated cells. Each of the cells holds an elongated fuel rod container that has a square cross-section. The cells of the eggcrate space the fuel rod containers from one another so as to maintain a subcritical state when the cells are completely loaded with nuclear fuel. As further assurance from subcriticality, the sides of each of the fuel rod containers are typically clad with a neutron-absorbing material, such as Boral®. The eggcrate of the basket structure is insertable into and removable from a cylindrical transportation casks that is typically formed from carbon steel which may be up to one foot thick. During the loading operation, the entire transportation cask is hoisted down into and completely submerged within a waterfilled cask-loading shaft on the premises of the nuclear reactor facility. Spent nuclear fuel rods are loaded into the containers held within the cells of the eggcrate of the basket structure. These spent fuel rods may either be held together in spent fuel assemblies or in consolidation canisters, either of which is receivable within the fuel rod container held in the cells of the eggcrate. After the loading operation has been completed, the entire transportation cask is hoisted upwardly by a crane above the surface of the water in the shaft, and allowed to drain. Thereafter, the cask is then lidded, and the fuel rods are transported to their final destination.

Unfortunately, such prior art basket structures are not without shortcomings. One of the most serious of these shortcomings is the tendency of the stainless steel plates in eggcrate type designs to warp in response to thermal and mechanical stress, which may result in the mis-shaping of one or more of the containers in the basket cells. Even relatively small amounts of warping may render the individual container useless, as the inner dimensions of the container are designed to hold either a spent fuel assembly or a consolidated fuel container with an absolute minimum amount of lateral "slack" so that the fuel rod assembly or fuel rod container will not tend to rattle within the basket structure when the transportation cask is in motion. Still another shortcoming associated with eggcrate type basket designs is their relative difficulty of manufacture. The interfitting slots in the plates that form the basket must be cut with a great deal of precision if the resulting cells are to be highly uniform in size. Moreover, when two interfitting plates are welded together along their mutually interlocking slots, the resulting weld beads can contract the metal along the slots to such an extent that the square cross sections of the eggcrate cells become warped into rhombi. If one attempts to correct such weld warpage by the application of counterwelds, one sometimes straightens one row of cells at the expense of buckling another row. It has been suggested that the warpage problem might be solved by merely increasing the size of the cells. Such a solution, however, would significantly increase the size and weight of the basket structure and would not necessarily solve the problem. Moreover, the greater amount of slack space resulting from such larger cells would create other problems that would have to be dealt with. A final shortcoming of eggcrate type designs is the difficulty of removing the rods from the basket in the event the cask is exposed to a damaging amount of mechanical shock. The mechanical interdependency of the interlocking plates may cause the entire basket structure to undergo severe warpage in a case where the casks is dropped on its side with one set of corners of the eggcrate vertically aligned, which in turn would tend to misshape all of the cells into flattened rhombi. Such a flattened rhombus shape would in turn cause the walls of the cells to pinch the fuel rods contained therein, thereby impeding removal.

Clearly, what is needed is an improved basket structure for use in a fuel rod transportation cask that is relatively simple and inexpensive to manufacture to samll tolerances, but yet which will maintain such dimensions tolerances throughout a broad range of thermal and mechanical stress. Ideally, such a structure would be devoid of small crevices and recesses so that the cask is easily drainable, and have good heat transfer characteristics so that residual heat from the spent fuel rods will be readily dissipated into the ambient atmosphere. Finally, the cells in the basket structure should be easily repairable in the case of an accident.

SUMMARY OF THE INVENTION

Generally speaking, the invention is an improved basket structure for use within a nuclear fuel transportation cask that overcomes the shortcomings associated with the prior art. The improved basket structure comprises a plurality of cells for receiving fuel rods, wherein the sides of each of the cells are formed from a plurality of elongated side members, each of which terminates in a flange of enlarged thickness along one of its lengthwise edges. The flange includes a slot that is complementary in shape to its free edge so that cells may be formed by interfitting the free edge of one side member with the complementary slot in the flange of another. The enlarged flange of each side member serves to space its respective cell from adjacent cells in order to maintain subcriticality, and to further provide part of a mechanical means for interconnecting the cells.

Each of the flanges may be integrally formed in its respective side member, and may include first and second legs that are orthogonal with respect to one another. The inside corner of the first and second legs of the flange may house the edge-receiving slot, and the outside corner is preferably beveled in order to define a recess for receiving a weld bead when flanges of different cells are abutted against one another.

In the preferred embodiment, each of the side members and its respective flange is unitarily extruded from an extrudable metal, and clad with a neutron-absorbing material such as Boral® on its outside surface in order to further ensure subcriticality. The modular construction of the basket structure of the invention from a plurality of uniformly dimensioned side members results in a basket structure that is simple and inexpensive to manufacture, to close tolerances but yet which is not prone to warping, and which further may be easily repaired in the event of shock damage. The cellular make-up of the basket structure makes it very easy to construct baskets having different numbers of cells without any significant amount of re-tooling. Hence the same manufacturing tooling may be used to construct basket structures small and light enough to be carried by truck, or heavy enough to be carried by train or barge. The modular basket structure is also devoid of small crevices and cavities that can retain water, which in turn allows the basket to be easily drained when hoisted out of a spent fuel pool. Finally, the mutually interconnected flange between the adjacent cells provide thermal conduction paths that facilitate the cooling of the cask.

BRIEF DESCRIPTION OF THE SEVERAL FIGURES

DETAILED DESCRIPTION OF THE PREFERRED EMBODIMENT

Figure 1:
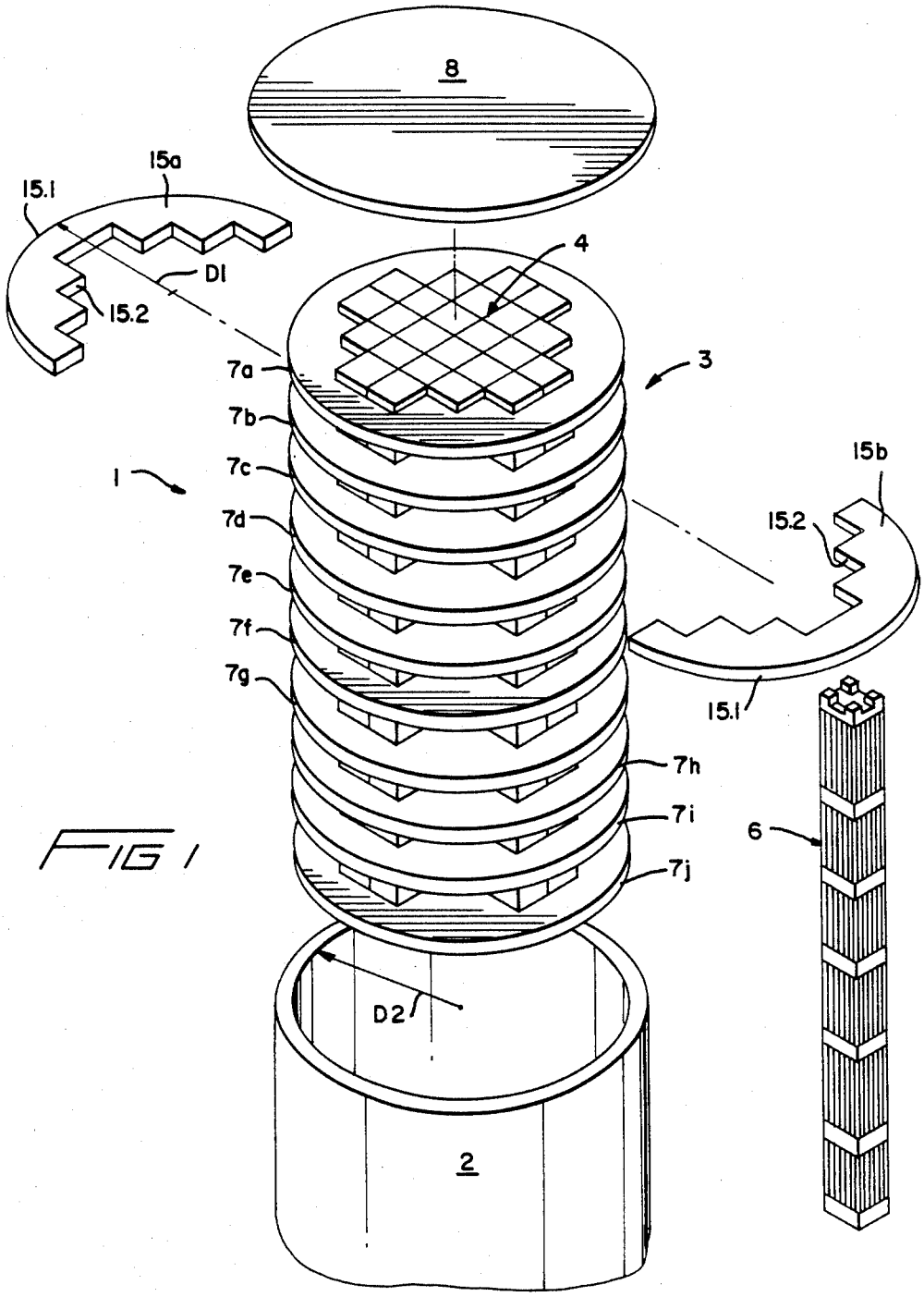
FIG. 1 is a perspective view of a transportation cask that utilizes the improved basket structure of the invention.

With reference to FIG. 1, wherein like numerals designate like components of the invention throughout all of the several figures, the transportation cask 1 of the invention includes a cylindrical vessel 2 for containing an improved basket structure 3. The basket structure 3 includes both a cell assembly 4 which may have twenty-four interconnected cells 5*a–x* for holding either fuel assemblies 6 or consolidated fuel cannisters (not shown), as well as a plurality of circular former plates 7*a–j* that circumscribe the cell assembly 4. It should be noted that the modular construction afforded by the use of individual cell structures allows the basket structure to have virtually any number of cells.

The cylindrical vessel 2 of the transportation cask 1 further includes a closure lid 8 which may be detachably mounted around the upper edge of the vessel 2 in a gas-tight seal. The floor (not shown) of the cylindrical vessel 2 is provided with a plurality of symmetrically arranged drain holes which may be selectively opened for draining water out of the interior of the vessel 2. The side walls of the cylindrical vessel 2 of the transportation cask 1 may be made from carbon steel that is approximately twelve inches thick. In the alternative, these walls may be a composite of stainless steel, lead and a neutron-absorbing plastic of a type known in the art. On the balance, carbon steel is the preferred material due to its relatively low-cost, high strength, and favorable heat conduction qualities.

Figure 2:
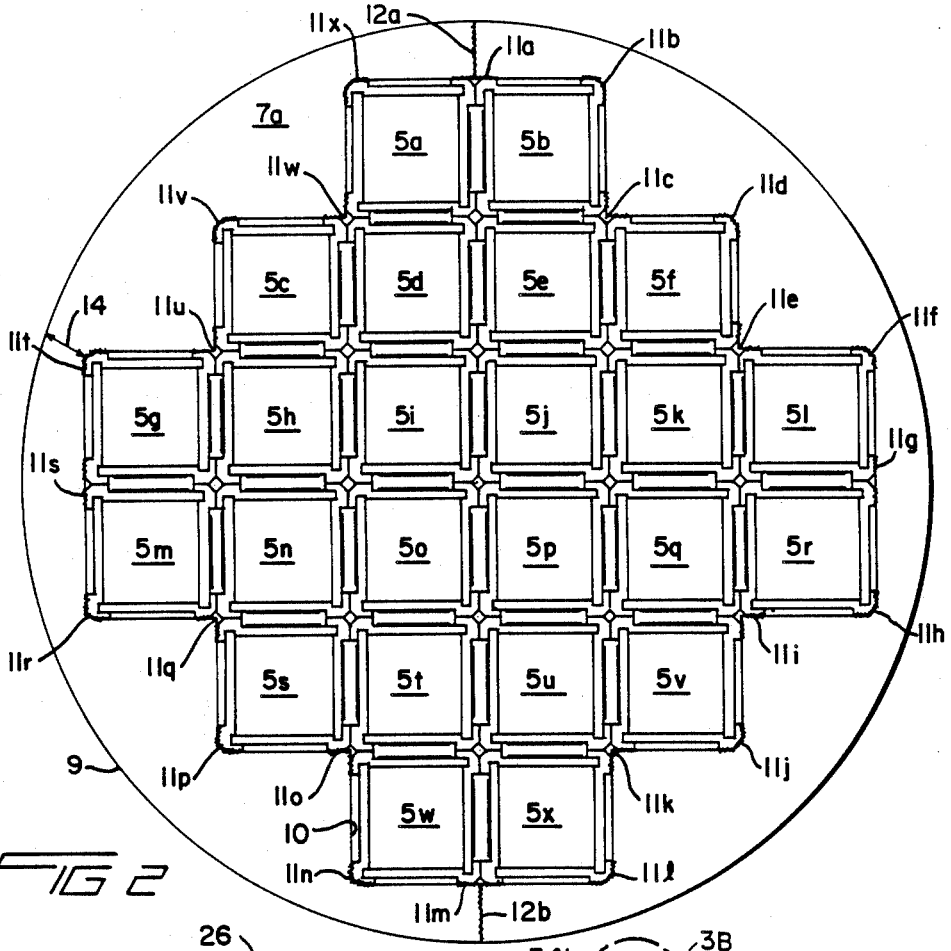
FIG. 2 is a plan view of the improved basket structure illustrated in FIG. 1.

With reference now to FIGS. 1 and 2, the former plates 7*a–j* each have a circular outer edge 9 whose diameter D2 is approximately the same as the inner diameter of the vessel 2, and a stepped inner edge 10 that is substantially complementary in shape to the perimeter of the cell assembly 4. In the preferred embodiment, both the cell assembly 4 and the former plates 7*a–j* are formed from aluminum, and interconnected at their respective corners by means of welds 11*a–x* which are applied on both the upper and lower surfaces of each of the plates 7*a–j*. To facilitate assembly, each of the former plates 7*a–j* is formed from two semicircular pieces that can be brought together much like the heat conductors 15*a,b* illustrated in FIG. 1 (and discussed in detail hereinafter), and interconnected by means of the welds 12*a, b* shown in FIG. 2. The minimum radial distance 14 between the outer corners of the cell assembly 4 and the outer diameter of the former plates 7*a–j* is at least one inch. Such dimensioning allows the former plates 7*a–j* to provide adequate support between the corners of the cell assembly 4 and the inner diameter of the vessel 2 without impeding the flow of heat from the spent fuel rods disposed within the cell assembly 4 to the outer walls of the vessel 2.

If the cell assembly 4 is fabricated from aluminum, ten former plates 7*a–j* approximately two inches thick are uniformly spaced throughout the approximately 160-inch length of the assembly 4 as is illustrated in FIG. 1. If, however, the cell assembly 4 is formed from a stronger but less heat-conductive metal such as type 304 stainless steel, the former plates 7*a–j* should also be formed from a type 304 stainless steel in order to avoid weld joints between dissimilar metals. Stainless steel former plates 7*a–j* need only be approximately one inch thick to provide sufficient mechanical support strength between the corners of the cell assembly 4 and the inner diameter of the vessel 1. However, because of the lower thermal conductivity of stainless steel as opposed to aluminum, nine pairs of semi-circular aluminum heat conductors 15*a,b* (of which only one pair is shown) should be inserted between all the former plates 7*a–j* so that the internal temperature of the vessel 2 does not exceed 380° C. Like the former plates 7*a–j*, the aluminum heat conductors 15a,b should have a circular outer edge 15.1, and a stepped inner edge 15.2 that is complementary in shape to the perimeter of the cell assembly 4. However, unlike the former plates 7*a–j*, the outer diameters D1 of these aluminum heat conductors 15*a,b* should be somewhat smaller than the inner diameter D2 of the cylindrical vessel 2 in order to compensate for the greater amount of thermal expansion that aluminum undergoes relative to stainless steel. Specifically, the outer diameters D1 of each of the nine pairs of heat conductors 15*a,b* should be dimensioned so that when these conductors are inserted between the former plates 7*a–j* and loaded into a vessel 2 along with a load of spent fuel rods, the resulting greater thermal expansion of the aluminum will cause it to differentially expand enough to come into a good thermal engagement between the inner walls of the vessel 2 and the outer walls of the cell assembly 4 without plastically deforming either the heat conductors 15*a, b* or the cell assembly 4. The provision of nine pairs of such aluminum heat conductors 15*a, b* between the parallel former plates 7*a–j* not only compensates for the relatively lower thermal conductivity of the stainless steel used in plates 7*a–j* in this embodiment, but also lends additional lateral support between the outer walls of the cell assembly 4 and the inner walls of the cylindrical vessel 2 in the event that the vessel 2 is dropped or otherwise exposed to an inadvertent mechanical shock. While it would be possible merely to thicken the former plates *7a–j* made from stainless steel until their heat conductivity is the same as that of aluminum plates, the relatively large amounts of stainless steel required for this purpose would render the transportation cask 1 quite heavy. The improved basket structure 3 of the instant invention may be used in conjunction with the inventive, shock-absorbing and heat conducting aluminum former plates described and claimed in co-pending U.S. patent entitled "Improved Shock-Absorbing and Heat-Conductive Basket for Use in a Fuel Rod Transportation Cask" assigned to the Westinghouse Electric Corporation, the entire specification of which is incorporated hereby by reference.

Figure 3A:
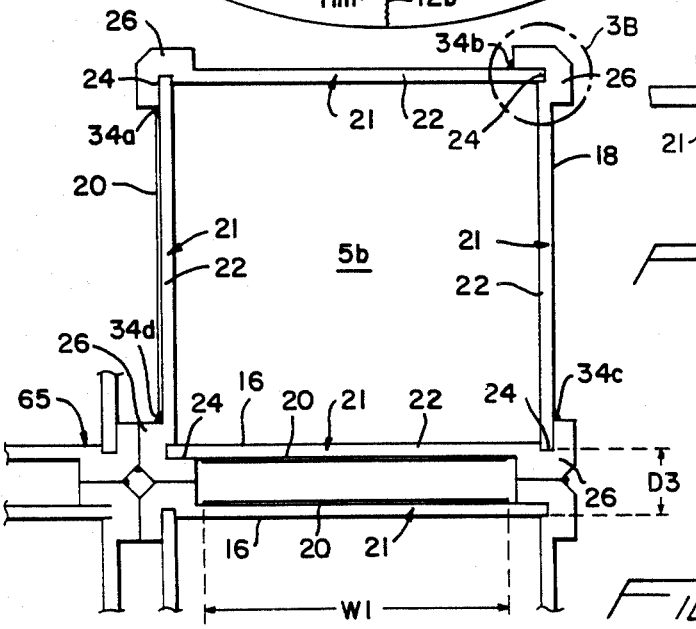
FIG. 3A is a plan view of one of the individual cells of the improved basket structure of the invention as it would appear when formed from four side members, wherein each side member forms one side of the cell.
Figure 3B:
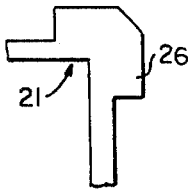
FIG. 3B is an enlarged view of how the corner of the cell that is circled in FIG. 3A would appear when the cell is formed from two side members, each of which forms two sides of the cell.
Figure 4:
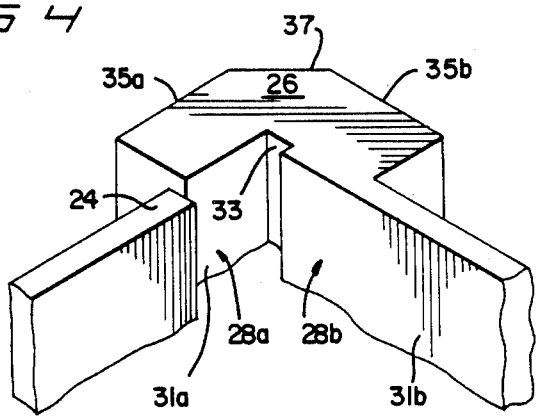
FIG. 4 is an enlarged, perspective view of two of the side members that form the cells of the improved basket structure, illustrating the enlarged flange on one end of the side member and the free edge of another side member.

With reference now to FIGS. 3 and 4, each of the individual cells *5a–x* that form the cell assembly 4 includes an elongated interior 16 having a square cross section that is approximately the same as the square cross section of a spent fuel assembly 6 (or consolidated spent fuel canister), as well as an exterior 18 that is preferably clad with sheets 20 of Boral® (or some other neutron-absorbing material) on all sides of the individual cell that face an adjacent cell. In the case of cell *5b* shown enlarged in FIG. 3, only the lower and left-hand sides need to be clad with Boral®, since these are the only sides of the cell *5b* that are adjacent to other cells. However, in the case of a cell such as *5d*, all four sides need to be clad as is indicated in FIG. 2. In all cases, Boral® sheet material is laminated over the outside surface of the walls of the cells *5a–x*.

As is best seen with respect to FIGS. 3A, 3B and 4, each of the cells *5a–x* may be formed from either four side members 21 or two side members orthogonally welded together depending upon whether the side member 21 forms one or two sides of the cells *5a–x*. In the FIG. 3A embodiment, each of these side members 21 is in turn formed from a rectangular plate 22 of aluminum or other extrudable metal having a free edge 24 along one of its lengths, and an enlarged flange 26 along its other length. Each of the enlarged flanges 26 is formed from a pair of short, orthogonally disposed legs *28a*, *28b*. Disposed between the inner surfaces *31a*, *31b* of the legs *28a*, *28b* is a short recess or slot 33. Slot 33 is complementary in shape to the free edge 24 of the rectangular plate 22 that forms each of the side members 21 so that the free edge 24 of one side member 21 may be inserted into the slot 33 of another side member 22 in the configuration illustrated in FIGS. 3 and 4. Four side members 21 may be permanently interconnected to form a single cell *5b* by means of welds *34a–d* which interconnect the enlarged flange 26 of one side member 21 to the outside of the rectangular plate 22 of another side member 21.

When each side member 21 forms two sides of the cell the structure of the cell *5b* in the FIG. 3B embodiment is exactly the same as the FIG. 3A embodiment, the only difference being that the upper right and lower left hand corners thereof are formed as shown.

Figure 5:
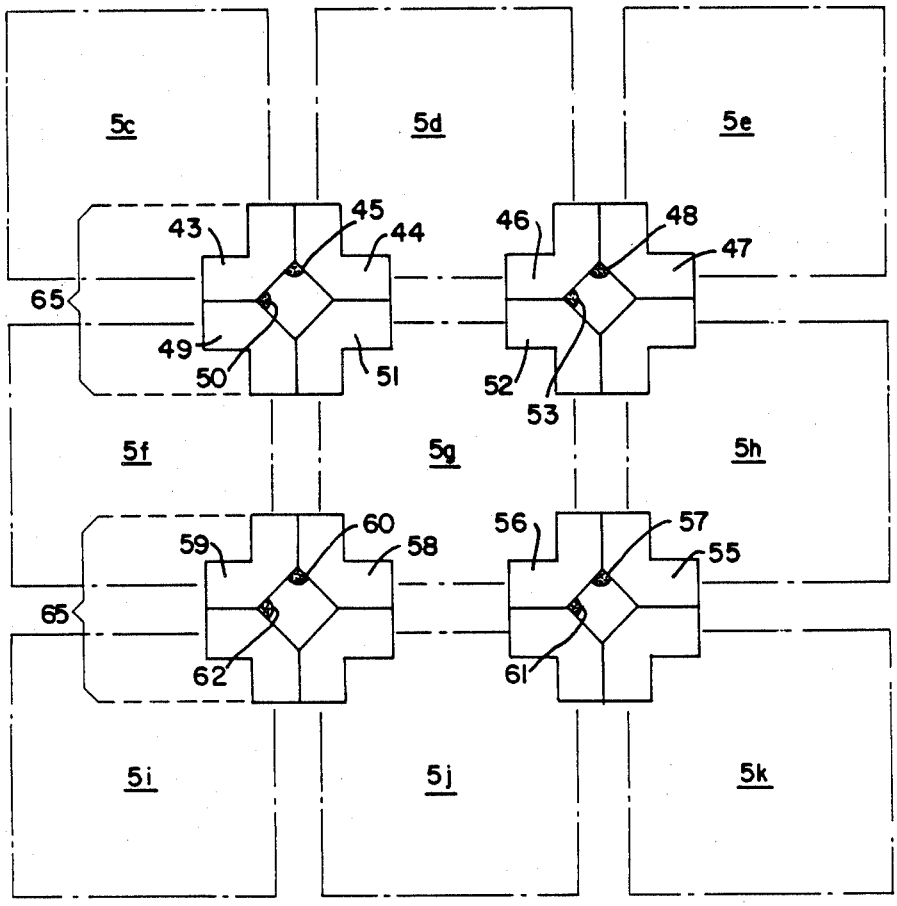
FIG. 5 illustrates the manner in which the individual cells of the basket structure are interconnected by weld beads.

The outer surfaces *35a*, *35b* of the legs *28a*, *28b* that form each of the enlarged flanges 26 are likewise orthogonally disposed with respect to one another, as is best seen in FIG. 4. These two outer surfaces *35a*, *35b* converge into a beveled portion 37 as indicated. The beveled portion 37 of each of the enlarged flanges 26 provide room for weld beads 45, 48, etc. that interconnect the flanges 26 disposed on the corners of each of the cells *5a* to connect the cells *5a–x* into the cell assembly 4 illustrated in FIG. 1. The precise manner in which this may be done is best seen with respect to FIG. 5. Specifically, flange corners 43 and 44 of cells *5c* and *5d* are interconnected by means of weld bead 45 that extends the entire 160-inch length of these cells. Next, flange corner 46 of cell *5d* is welded to flange 47 of cell *5e* by means of weld 48, thereby resulting in three, interconnected cells *5c*, *5d* and *5e*. The flange corner 49 of cell *5f* is then connected to flange corner 43 of cell *5c* by means of weld 50. Next, cell *5g* is placed in the position shown. Flange 51 of cell *5g* is not welded onto adjacent flange corner 44 of cell *5d* and corner 49 of cell *5f* for two reasons. First, the provision of such a weld in this location is not necessary for either the structural or the thermal integrity of the basket structure 3 since all the other flange corners 52, 56 and 58 of cell *5g* can be connected to adjacent flange corners by means of other welds. Secondly, it is desirable to avoid the application of unnecessary welds on the basket structure 3 in order to expedite fabrication, and to minimize the chances of any weld-induced warpage.

In the next step of assembling the cell assembly 4, cell *5h* is placed in the position shown. For the same reasons given with respect to flange corner 51 of cell *5g*, flange corner 54 of cell *5h* is not welded to adjacent flange corners 52 and 47 of cells *5g* and *5e*. However, flange corner 55 of cell *5h* can be welded to flange corner 56 of cell *5g* by means of weld 57. Moreover, flange corner 58 of cell *5g* can further be welded onto flange corner 59 of cell *5f* by means of weld 60. Similarly, cells *5i*, *5j* and *5k* are interconnected to the cell assembly 4 by means of welds 61, 62 and other welds (not shown) which follow the same pattern. The end result is that each of the cells *5a–x* is welded at at least three of its corners to either adjacent cells, or to the stepped interiors 10 of the previously discussed former plates *7a–j*.

As is best seen in FIG. 3, the welding together of four of the enlarged flanges 26 of adjacent cells *5a–5x* (such as cells *5c–5k*) creates spacing blocks 65 which securely interconnect the cells *5a–x* into a single cell assembly 4, and further serve the purpose of spacing the interiors 16 of each of the cells *5a–x* a distance D3 so that subcriticality is maintained between the fuel rods loaded into each of the cells *5a–x*. The legs *28a*, *28b* of each of the flanges 26 of the side members 21 are thick enough so that the flange 26 will not warp when welded to an adjacent flange, but yet which are short enough to allow for cladding Boral® sheet 20 of sufficient width W1 to cover the side member 21 so neutrons radiating out of the fuel rods disposed in the cells *5a–x* will generally have to penetrate two layers of Boral® before penetrating into the rods held in an adjacent cell. Such a cladding configuration provides further assurance that the fuel rods loaded into the improved basket structure 3 will remain subcritical. Finally, it should be noted that in the event that the cask 1 receives a severe mechanical shock on its side, most of the shock would tend to be absorbed by the cells *5a–x* closest to the point of impact. The generally cellular structure of the cell assembly 4 would help to minimize the amount of warpage and buckling experienced by the cells *5a–x* farthest away from the point of impact. The end result is that in all but the most severe accidents, the shape of some if not most of the cells *5a–x* would be preserved to the extent that many of the rods disposed in the basket structure 3 would not be pinched or otherwise bound within their respective cells, hence allowing for easy rod recovery.

While the term "side member" has been used herein to refer to member that forms only one side of a cell, it should be noted that angular side members may be formed which create two sides of a four-sided cell, and that the term "side member" is to be read in such a liberal sense.

I claim:

1. An improved basket structure for a cask for transporting nuclear fuel rods, comprising a plurality of cells for receiving fuel rods, wherein each cell includes at least three sides, the sides of each cell being formed from a plurality of elongated side members of substantially equal dimensions, each side member including two opposing lengthwise edges, one of which is free and the other of which terminates in a flange of enlarged thickness, wherein said flange includes a slot that is complementary in shape to the free edge so that said cells may be formed by interfitting the free edge of one side member with the complementary slot in the flange of another side member, and wherein said flange further serves to space the cell that it partially forms from adjacent cells, and to provide a means for interconnecting said cells.

2. The basket structure of claim 1, wherein each of said cells is substantially square in cross-section, and formed from four orthogonally interfitted side members.

3. The basket structure of claim 1, wherein each of said cells is substantially square in cross-section, and formed from two opposing, interfitted side members, each of said side members forming two orthogonal sides of the resulting cells.

4. The basket structure of claim 1, wherein each of said flanges is integrally formed with its respective side member.

5. The basket structure of claim 1, wherein each of said side members includes an inside surface that faces the interior of the cell that it partially forms, as well as an outside surface, and wherein the outside surface is substantially covered with a neutron-absorbing material.

6. The basket structure of claim 1, wherein the flanges of adjacent cells are formed of a metallic material and are welded together in order to form said basket structure.

7. The basket structure of claim 6, wherein said side members are each formed from an extruded metal.

8. An improved basket structure for a cask for transporting nuclear fuel rods, comprising a plurality of cells for receiving fuel rods, wherein each cell includes at least three sides, the sides of each cell being formed from a plurality of elongated side members of substantially equal dimensions that are formed from an extrudable metal, each side member including two opposing lengthwise edges, one of which is free and the other of which terminates in a flange that is substantially thicker than said free edge, wherein said flange includes a slot that is complementary in shape to its free edge so that individual rod receiving cells may be formed by interfitting the free edge of one side member with the complementary slot in the flange of another side member and welding the free edge therein, and wherein each of said flanges serves to space the cell that it partially forms from adjacent cells, and to provide a means for interconnecting said cells.

9. The basket structure of claim 8, wherein each of said flanges includes a first leg that is parallel to its respective side member, and a second leg that is orthogonal with respect to the first leg.

10. The basket structure of claim 9, wherein the first and second legs of each flange include an inside corner that faces the interior of the cell that its respective side member partially forms, and wherein the edge-receiving slot of the flange is located within said inside corner at the junction of said legs.

11. The basket structure of claim 9, wherein the first and second legs of each flange include an outside corner that faces the exterior of the cell that its respective side member partially forms, and wherein said outside corner is beveled in order to define a recess for receiving a weld bead when flanges of different cells are abutted against each other.

12. The basket structure of claim 9, wherein each of said cells is substantially square in cross-section, and formed from four orthogonally interfitted side members.

13. The basket structure of claim 9, wherein each of said cells is substantially square in cross-section, and formed from two opposing, interfitted side members, each of said side members forming two orthogonal sides of the resulting cells.

14. The basket structure of claim 8, wherein the flanges of four adjacent cells are at least partially interconnected to form spacing blocks between adjacent cells.

15. An improved basket structure for a cask for transporting nuclear fuel rods, comprising a plurality of cells for receiving fuel rods, wherein each cell is an independent structure having a plurality of sides formed from side member which include two opposing lengthwise edges, one of which is free and the other of which is characterized by an enlarged flange, having a slot and wherein said basket structure is formed by interfitting and interconnecting the free edge of one side member with the slot in the flange of another side member to form an array of cells, wherein said enlarged flange serves to space said cells apart from one another.

16. The basket structure of claim 15, wherein the fuel rods contained within any two interconnected cells are subcritically spaced when said enlarged flanges are interconnected.

17. The basket structure of claim 16, wherein the cells are formed from aluminum, and the cell walls are clad with a neutron-absorbing material.

18. The basket structure of claim 15, wherein each of said cells is substantially square in cross-section, and formed for four orthogonally interfitted side members.

19. The basket structure of claim 15, wherein each of said cells is substantially square in cross-section, and formed from two opposing, interfitted side members, each of said side members forming two orthogonal sides of the resulting cells.

20. The basket structure of claim 18, wherein each of said flanges is integrally formed with its respective side member.

* * * * *